United States Patent [19]

Saba et al.

[11] Patent Number: 4,596,434

[45] Date of Patent: Jun. 24, 1986

[54] SOLDERLESS CONNECTORS FOR SEMI-RIGID COAXIAL CABLE

[75] Inventors: Robert A. Saba, Walpole; Roger R. Ducharme; Paul F. Harhen, both of Westford, all of Mass.

[73] Assignee: M/A-COM Omni Spectra, Inc., Merrimack, N.H.

[21] Appl. No.: 692,316

[22] Filed: Jan. 16, 1985

Related U.S. Application Data

[63] Continuation of Ser. No. 460,038, Jan. 21, 1983, abandoned.

[51] Int. Cl.[4] ..... H01R 17/18

[52] U.S. Cl. ..... 339/177 R; 339/95 A; 339/276 R

[58] Field of Search ..... 339/177, 276 R, 89 C, 339/90 C, 95 R, 95 A, 97 C

[56] References Cited

U.S. PATENT DOCUMENTS

| | | | |
|---|---|---|---|
| 2,296,766 | 9/1942 | Bruno | 339/177 R |
| 3,077,513 | 2/1963 | Felts | 174/75 |
| 3,196,382 | 7/1965 | Morello | 339/177 R |
| 3,331,917 | 7/1967 | O'Keefe et al. | 339/276 R |
| 3,537,065 | 10/1970 | Winston | 339/276 R |
| 3,581,269 | 5/1971 | Frey | 339/177 E |
| 3,598,895 | 8/1971 | Garland | 339/177 R |
| 3,668,612 | 6/1972 | Nepovim | 339/177 R |
| 3,678,176 | 7/1972 | Reimer | 339/276 R |
| 3,757,279 | 9/1973 | Winston | 339/177 R |
| 3,778,535 | 12/1973 | Forney, Jr. | 339/177 R |
| 3,846,738 | 11/1974 | Nepovim | 339/177 R |
| 4,400,050 | 8/1983 | Hayward | 339/177 R |

FOREIGN PATENT DOCUMENTS 2800772 7/1978 Fed. Rep. of Germany .

*Primary Examiner*—Gil Weidenfeld
*Assistant Examiner*—David L. Pirlot
*Attorney, Agent, or Firm*—Hayes, Davis & Soloway

[57] ABSTRACT

A solderless connector for semi-rigid coaxial cable having an elongate annular outer conductor, a center conductor coaxial with said outer conductor and a dielectric material spacing the inner and outer conductors apart, the connector comprising a housing having an annular portion defining a bore adapted to encompass said outer conductor and a bushing defining a bore to engage the exterior of the annular portion to circumferentially compress said annular portion upon telescoping movement of said bushing over said annular portion, said housing bore having, integral therewith, means adapted to engage said outer conductor upon said circumferential compression to provide a mechanical and electrical interface between said housing and said outer conductor.

12 Claims, 5 Drawing Figures

SOLDERLESS CONNECTORS FOR SEMI-RIGID COAXIAL CABLE

This is a continuation of application Ser. No. 460,038 filed Jan. 21, 1983, now abandoned.

The present invention relates to solderless connectors suitable for use with semi-rigid coaxial cable.

Semi-rigid coaxial cable, which is used, particularly, where a high degree of RF shielding is required, comprises a solid tubular outer conductor, usually of copper, centrally disposed within which is an inner conductor spaced from the outer conductor by a dielectric material.

Direct solder attachment of connectors to semi-rigid cable has, until now, been the only reliable arrangement where a connector is required to function reliably in extreme environmental conditions which may include high vibration levels and high continuous/oscillating mechanical and thermal stress.

Such direct solder attachment of the connector body to the copper sheath of a semi-rigid coaxial cable has always been a production problem because of the experience and skills that have to be developed to maintain an efficient operation. A narrow time/temperature range is needed to promote solder flow while minimizing undesirable heating effects on the confined cable dielectric. In addition, precision equipment is necessary for repeatable connector positioning. In spite of these difficulties, mechanical cable/connector junctions have not gained wide acceptance. Bulk, cost, lack of permanency, and to some extent, poor performance have been against mechanical connectors. Special cable preparation has led to only limited acceptance of a connector design utilizing a crimp to preknurled cable arrangement. Nevertheless, a mechanical concept, with designed-in control of the assembly is desirable for consistent performance and for improved productivity.

Although solderless connectors are well-known and have been widely used in many applications for flexible and semi-rigid cable assemblies, there useful application has been limited to situations in which vibration and stress are not problems.

A basic requirement in providing a solderless connector for use in such extreme environment conditions is that of providing mechanical and electrical interconnection of high integrity between the outer conductor and the connector itself. A recent attempt at providing such a connector is embodied in AMP Incorporated's SMA coaxial connector which is described and illustrated on Pages 261 and 262 of AMP Inc.'s catalog entitled "AMP Guide to RF Connectors," Catalog 80-570 published 7/82.

The AMP connector for semi-rigid coaxial cables utilizes a ferrule or gripper ring which interconnects the main housing of the connector with the outer conductor of the semi-rigid cable. The gripper ring in this design includes a plurality of teeth extending from the annular end of the ring axially of the connector and arranged to be deformed or bent radially inwardly to engage the outward conductor of the cable upon the application of a force to telescope the ferrule and housing together. By this telescoping action the teeth are bent inwardly to engage the outer conductor while the main housing achieves an interference fit with the ferrule thereby to retain the connector on the cable. In this design the mechanical and electrical integrity of the mounting of the connector on the cable involves, firstly, the integrity of the connection between the ferrule and the outer conductor of the cable and, secondly, the interference fit between the ferrule and the housing. Failure of either of these will destroy the integrity of the mounting of the connector on the cable. In particular, it has been found that the interference fit between the ferrule and the housing is subject to failure upon the application of a longitudinally acting force on the connector relative to the cable which is of a magnitude insufficient to damage the cable or the connection of the ferrule with that cable.

It is an object of the present invention to provide an improved solderless connector for semi-rigid coaxial cable which provides high mechanical and electrical integrity under extreme environmental conditions in a design which is simple and economical to install (and repair or replace) using simple tools and which is more economical to produce and compact in form.

According to the present invention there is provided a solderless connector for semi-rigid coaxial cable comprising a connector housing including a portion defining a cable encompassing opening having cable engaging means formed integrally therewith and means to circumferentially compress said portion about a said cable, when in said opening, to bring said engaging means into engagement with said cable and to maintain that engagement.

The invention will now be described, by way of example, with reference to the accompanying drawings in which.

Figure 1:
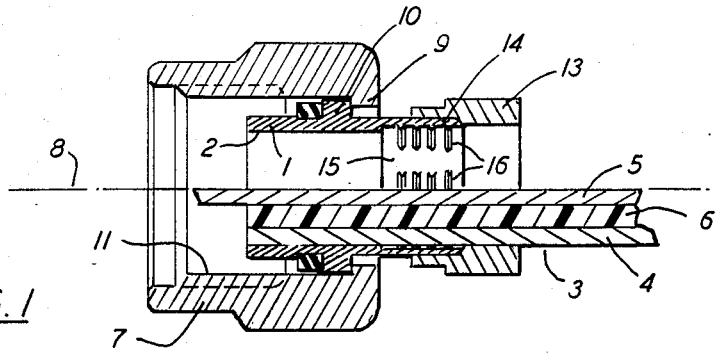
FIG. 1 is a sectional elevation of a solderless connector in the form of a straight cable plug ready for installation on the prepared end of a semi-rigid coaxial cable, only the portion of the cable on one side of the center line of the connector being shown.

With reference first to FIG. 1, an annular monolithic housing 1 defines a cylindrical bore 2 of a diameter to accommodate in close spaced relationship the outside surface of a semi-rigid coaxial cable 3. This cable comprises an annular elongate copper outer conductor 4 concentrically within which extends a copper center conductor 5 with a dielectric material 6 disposed therebetween. A coupling nut 7 is mounted on the housing for rotation relative thereto about central axis 8. The coupling nut has an inwardly extending annular flange 9 arranged to cooperate with an outwardly extending annular flange 10 on the exterior of the housing 1 to permit the mechanical and electrical interconnection of the connector cable assembly with, for example, a corresponding cable jack such as that illustrated in FIG. 4, upon the engagement of the female thread 11 of the nut 7 with the corresponding male thread 12 (see FIG. 4) of that jack.

A bushing 13 is pre-loaded onto the rear end 14 of the housing 1 prior to the assembly of the connector onto the cable 3. The preloading of the bushing 13 serves to provide for ease of handling and holds the nut 7 captive.

Figure 2:
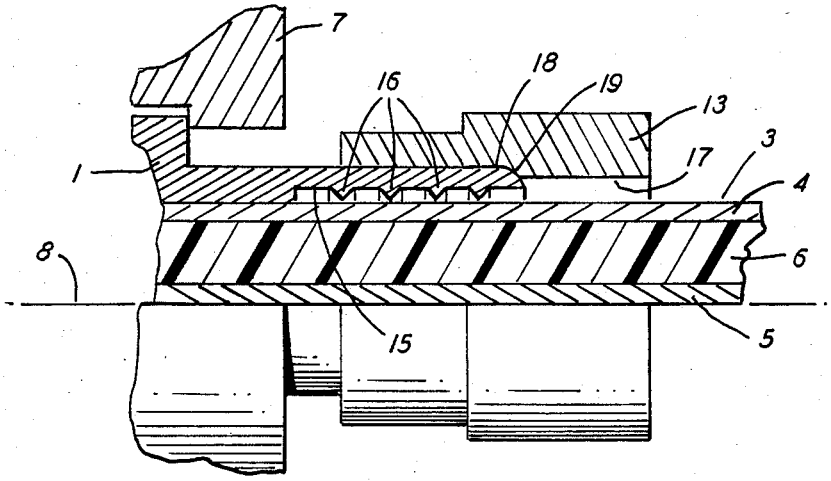
FIG. 2 is an enlarged fragmentary view of the connector illustrated in FIG. 1 showing in greater detail the arrangements for mounting the connector and the cable when in position preparatory to such mounting.

With reference now to both FIGS. 1 and 2, the housing 1 has a cylindrical counterbore 15 concentric with the axis 8 at its rear end 14 with a plurality of elongate teeth 16 projecting inwardly from the cylindrical surface of the counterbore toward the axis 8. The tips of these teeth define an imaginary cylindrical surface of the same diameter, prior to the mounting of the connector of a cable 3, as and coaxial with the bore 2.

Four equally spaced apart rows of teeth are provided. These rows each comprise four teeth, equally spaced apart round the circumference of the counterbore 15, lying in a plane normal to the axis 8. The teeth are of generally symmetrical triangular cross-section and have a length, around said circumference, approximately equal to the space, around said circumference, between adjacent teeth.

While the exemplary form of connector has been described with a specific arrangement of teeth, it will be appreciated that other arrangements and shapes of teeth, for example, different numbers of rows, different arrangements of teeth from row to row, elongate teeth some of which extend parallel to the axis 8, teeth forming individual closed circles (with or without holes, extending radially through said rear end 14 therein), teeth of asymmetric cross-section to asymmetrically resist longitudinal and/or torsional forces applied to the connector relative to the cable or of conical or frusto-conical form may be utilized without departing on the concept of the present invention.

The mounting of the connector onto the cable 3 is achieved by sliding the connector onto the cable into the position shown in FIG. 1 with the bore 2 and the tips of the teeth 16 in close proximity to the outer surface of the outer conductor 4. The housing 1 and bushing 13 are then telescoped together by the application of a telescoping force longitudinally of the axis 8 as may be applied by a hand operated tool adapted for this purpose. This telescoping action compresses the rear end 14 of the housing circumferentially, and thereby moves the teeth 16 radially inwardly, by virtue of the interaction of cylindrical bore 17 of bushing 13 with the cylindrical outer surface 18 of the rear end 14 of the housing 1, the bore 17 being of a smaller diameter than the surface 18. The radial thickness and outer diameter of the rear end 14 is chosen relative to the material and dimensions of the bushing 13 to provide a desired movement of teeth 16 radially inwardly toward axis 8. Interacting frusto-conical surfaces 19 on the bushing 13 and the rear end 14 disposed at appropriate angle to axis 8 to facilitate initial telescoping action to bring the bore 17 into initial contact with the surface 18. The telescoping action is continued until the housing 1 and bushing 13 occupy the position illustrated in FIG. 3 with the bushing 13 abutting the outwardly extending annular flange 10 of the housing.

The radially inward deformation of the rear end causes the surface of counterbore 15 to engage and the teeth 16 to engage and deform the surface of the conductor 4 to provide a positive mechanical and electrical interface therewith. The circumferential extension of the teeth provides substantial annular communication between the housing and the outer conductor thereby to strongly resist the longitudinal movement of the housing on the cable upon the application of axial forces on the connector relative to the cable. The circumferentially extending gaps between the teeth serve to resist torsional forces attempting to twist the connector around axis 8 about the cable.

With the connector of the present invention, the integrity of the mechanical and electrical interconnection between the outer conductor of the cable and the connector depends upon only a single interface, namely the interface between the teeth 16 and rear end 14 with the outer conductor and the cable. The superiority of such an arrangement over the prior art connector described above with its reliance upon two serially disposed interfaces for mechanical and electrical mounting integrity, with the resulting double chance of failure will be readily apparent to one skilled in the art.

Figure 3:
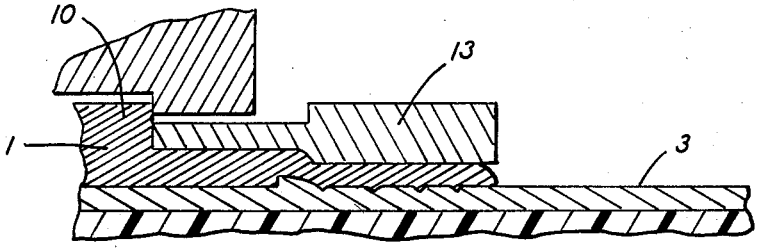
FIG. 3 is a fragmentary view similar to that of FIG. 2 with the connector mounted on the cable.
Figure 4:
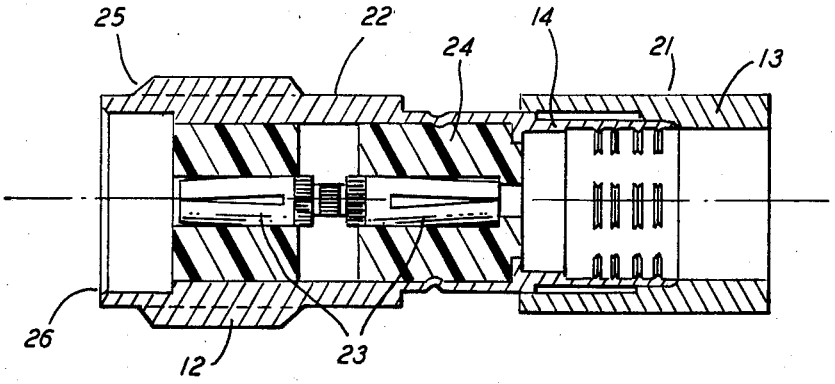
FIG. 4 is a sectional elevation of a solderless straight cable jack utilizing the mounting arrangements of the connector illustrated in FIGS. 1, 2 and 3.

With reference now to FIG. 4, there is illustrated a straight cable jack 21 having mounting arrangements similar to those described with reference to FIGS. 1, 2 and 3, for the mounting of the jack onto a semi-rigid coaxial cable. In this arrangement the housing 22 has a rear end 14 similar to that illustrated in FIGS. 1, 2 and 3 on which is preloaded a bushing 13. In addition housing 22 supports opposed electrically interconnected contacts 23 by means of a dielectric 24, one adjacent the rear end 14 for engagement with the center conductor of a cable upon which the jack 21 is mounted. The forward end 25 has a male thread 25 to facilitate connection with a plug such as described with reference to FIGS. 1, 2 and 3, by means of engagement of the coupling nut 7 with the forward end 25; the center conductor of the cable upon which that plug is mounted engaging the other female contact 23 which is located adjacent the forward end 25.

The annular face terminating the forward end 25 is adapted when the jack is connected to a plug as shown in FIGS. 1, 2 and 3, to sealingly engage an annular gasket 27 captively mounted in an annular groove formed in an exterior surface of housing 1 adjacent the outwardly extending flange 10, within the coupling nut 7.

Figure 5:
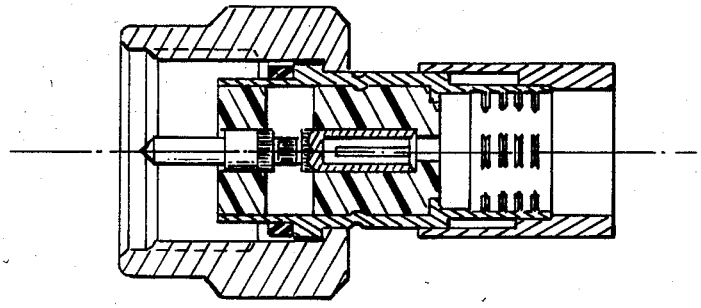
FIG. 5 is a solderless straight cable plug utilizing the mounting arrangement of the connector illustrated in FIGS. 1, 2 and 3.

FIG. 5 illustrates a cable plug having mounting arrangements similar to those described with reference to FIGS. 1, 2 and 3 with the housing of this plug supporting electrically interconnected female and male contacts by means of a dielectric, the female contact being adapted to communicate with the center conductor of a cable on which the cable plug is mounted and with the male contact projecting into the interior of a coupling nut for engagement with a cable jack such as illustrated in FIG. 4.

While the present invention has not been described with reference to the use of any particular materials, suitable materials will be apparent to a man skilled in the art, including constructing the electrically conductive components from any suitable material including stainless steel and that these components may be be gold plated.

We claim:

1. A solderless connector for semi-rigid coaxial cable having an elongate annular outer conductor, a center conductor coaxial with said outer conductor and a dielectric material spacing the inner and outer conductors apart, the connector comprising a housing having an annular portion defining a cylindrical circumferentially continuous bore adapted to encompass said outer conductor and a cylindrical circumferentially continuous bushing defining a bore to engage the exterior of the annular portion the bushing bore being smaller in diameter than the outer diameter of said annular portion to an extent whereby upon telescoping movement of said bushing over said annular portion a desired circumferential compression of said annular portion occurs to produce desired radial inward deformation of said annular portion, said housing bore having, integral therewith, means adpated to engage said outer conductor upon said circumferential compression to provide a direct mechanical and electrical interface between said housing and said outer conductor.

2. A connector according to claim 1 wherein said bushing is adapted for pre-loading engagement with said annular portion.

3. A connector according to claim 1 in the form of a cable plug further comprising a coupling nut captively mounted on said housing for rotation relative thereto.

4. A connector according to claim 1 in the form of a cable jack wherein said housing defines a forward end carrying a male thread and supports opposed electrically interconnected female contacts within the housing, by means of a dielectric material, to provide electrical interconnection between a cable to which a cable is mounted and a cooperating cable plug.

5. A connector according to claim 1 wherein said bushing and said annular portion are provided with cooperating frusto-conical surfaces angled to facilitate initiation of telescoping movement of the bushing over said annular portion upon the application of longitudinally acting forces to produce said telescoping movement.

6. A connector according to claim 5 wherein said housing bore is cylindrical and said means comprise a plurality of radially inwardly extending teeth.

7. A connector according to claim 6 wherein said teeth are elongate and aligned to form a row of teeth, extending from the cylindrical surface, disposed circumferentially about said housing bore.

8. A connector according to claim 7 comprising a plurality of said rows of teeth spaced apart longitudinally of the axis of the housing bore.

9. A connector according to claim 6 wherein said teeth are elongate teeth extending and spaced apart round the circumference on the cylindrical surface of said housing bore.

10. A connector according to claim 9 wherein the circumferential extension of each tooth is approximately equal to the circumferential spacing between adjacent teeth.

11. A connector according to claim 1 in which said housing defines an abuttment to positively limit telescoping motion of the bushing over said annular portion.

12. A connector according to claim 11 wherein said connector is a cable plug further comprising a coupling nut disposed for rotation about said housing and held captive between said abuttment on said housing and a further abuttment surface on said bushing.

* * * * *